United States Patent [19]

Gutberlet et al.

[11] 4,383,916

[45] May 17, 1983

[54] SWEETENING AND DESULFURIZING SULFUR-CONTAINING HYDROCARBON STREAMS

[75] Inventors: L. Charles Gutberlet, Wheaton; Ralph J. Bertolacini, Naperville; Allen A. Kozinski, St. Charles, all of Ill.; Craig L. Hooper, Houston, Tex.

[73] Assignee: Standard Oil Company (Indiana), Chicago, Ill.

[21] Appl. No.: 297,273

[22] Filed: Aug. 28, 1981

[51] Int. Cl.[3] ..... C10G 45/12

[52] U.S. Cl. ..... 208/189; 208/214; 208/240

[58] Field of Search ..... 208/213, 214, DIG. 2, 208/99, 240, 189

[56] References Cited

U.S. PATENT DOCUMENTS

| | | | |
|---|---|---|---|
| 3,051,646 | 8/1962 | Brooke | 208/91 |
| 3,126,331 | 3/1964 | Landis et al. | 208/99 |
| 3,620,969 | 11/1971 | Turnock | 252/411 S |
| 3,725,299 | 4/1973 | Turnock et al. | 252/411 S |
| 3,783,125 | 1/1974 | Ondrey et al. | 208/189 X |
| 3,835,031 | 9/1974 | Bertolacini et al. | 208/113 |
| 3,846,288 | 11/1974 | Chun et al. | 208/240 |
| 4,098,684 | 7/1978 | Innes | 208/245 |
| 4,324,650 | 4/1982 | Carlson et al. | 208/207 |

*Primary Examiner*—Delbert E. Gantz
*Assistant Examiner*—O. Chaudhuri
*Attorney, Agent, or Firm*—Lansing M. Hinrichs; William T. McClain; William H. Magidson

[57] ABSTRACT

A process for sweetening and desulfurizing a sulfur-containing hydrocarbon stream boiling at a temperature less than about 650° F. The process comprises contacting the hydrocarbon stream with an oxidic catalyst at a temperature of about 300 to 650° F. and at a pressure of about 1 to 5 atmospheres. The oxidic catalyst comprises a molecular sieve selected from the group consisting of hydrogen-form molecular sieves and rare-earth-form molecular sieves.

17 Claims, No Drawings

SWEETENING AND DESULFURIZING SULFUR-CONTAINING HYDROCARBON STREAMS

FIELD OF THE INVENTION

This invention relates to the sweetening and desulfurizing of sulfur-containing hydrocarbon streams. The term "sweetening" is intended to describe the conversion of certain undesirable sulfur compounds, particularly the mercaptans, into other sulfur compounds which remain in the hydrocarbon stream. The term "desulfurizing" is intended to describe the actual removal of sulfur from the hydrocarbon stream.

BACKGROUND OF THE INVENTION

1. Sulfur in Hydrocarbons

Elemental sulfur and sulfur compounds are naturally present in crude petroleum. The amount of sulfur varies over a wide range; for example, crude petroleum from West Texas contains about 0.2 weight percent sulfur whereas crude petroleum from Saudi Arabia contains about 5.0 weight percent sulfur. The types of sulfur compounds present in the crude also exhibit a wide variety. These compounds range from hydrogen sulfide, which is a gas at room temperature, to heavy sulfur compounds which boil at over 1000° F.

When crude petroleum is processed in an oil refinery, one of the first steps is to separate the crude into various fractions based on boiling points. The unit used for this separation is a distillation column operated at atmospheric pressure and commonly called the crude still. The separation of the hydrocarbons also separates the sulfur compounds so that the lower-boiling hydrocarbons contain lower-boiling sulfur compounds and higher-boiling hydrocarbons contain higher-boiling sulfur compounds.

2. Sweetening versus Desulfurizing

The sulfur compounds are undesirable in every hydrocarbon fraction coming off the crude still; however, the cause of the undesirability varies from fraction to fraction. It follows that, while most fractions are preferably treated as they come off the crude still to somewhat counteract the bad effects of the sulfur compounds, the preferred method of treatment varies from fraction to fraction.

For example, the lower-boiling fractions contain certain sulfur compounds, particularly the mercaptans (RSH), which are notoriously malodorous. This odor is responsible for the term "sour" which is often used to decribe a hydrocarbon fraction containing unacceptably high amounts of mercaptans. This odor is also responsible for specifications which limit the amount of mercaptan sulfur in certain products; for example, jet fuel must contain less than 30 parts per million (ppm) of mercaptan sulfur to meet the ASTM Standard D1655. If the odor is the only problem caused by the sulfur compounds, the hydrocarbon fraction can be "sweetened" by merely converting the mercaptans into other, less odorous compounds such as sulfides or disulfides.

On the other hand, sometimes the sulfur itself must be removed, regardless of the type of compound involved, and a desulfurization process is required. For example, the light virgin naphtha fraction, also called straight-run gasoline, is generally desulfurized if tetraethyl lead is to be added to increase octane rating since sulfur mutes the octane response. Similarly, the heavy virgin naphtha fraction is generally desulfurized if it is to be processed in a reformer since sulfur tends to poison the reforming catalyst.

It is little wonder that an enormous amount of technology has developed relating to sweetening and desulfurizing. There are five basic processes which have been taught for sweetening and/or desulfurizing: (1) oxidation reactions, (2) solvent extraction, (3) adsortipn, (4) metal catalysis, and (5) hydrodesulfurization.

3. Oxidation Reactions

The first basic process sweetens sour hydrocarbon streams by the addition of a chemical reagent which oxidizes the mercaptans to form sulfides and/or disulfides. One version of this process is the so-called Doctor process in which a solution of sodium plumbite in sodium hydroxide is added to the hydrocarbon stream. The sodium plumbite reacts with the mercaptans to form lead mercaptides. The lead mercaptides then react with free sulfur, which is either inherent in the hydrocarbon stream or is added, to form disulfides and lead sulfide. A phase separation is then made with the disulfides concentrating in the hydrocarbon phase and the lead sulfide concentrating in the sodium hydroxide phase. The lead sulfide is subsequently regenerated to sodium plumbite and reused.

The Doctor process is very effective at converting mercaptans, but it does suffer from certain disadvantages. One disadvantage is that some lead sulfide remains in the hydrocarbon stream. Another disadvantage is that stoichiometric amounts of sodium plumbite and free sulfur must be used. If too little sulfur is used, lead mercaptides remain in the hydrocarbons, and if too much sulfur is used, corrosiveness becomes a problem. A third disadvantage is the necessity of making a phase separation between the hydrocarbons and the treating solution.

Copper sweetening is a second process which uses an oxidation reaction to form disulfides. In copper sweetening, cupric chloride is added to the hydrocarbon stream. The cupric chloride reacts with mercaptans to form cuprous mercaptides which then react with more cupric chloride to form disulfides and cuprous chloride. The cuprous chloride is then regenerate to cupric chloride. Like the Doctor process, copper sweetening is effective but various undesirable metal compounds remain in the treated hydrocarbon stream and a phase separation is necessary.

The third major sweetening process based on an oxidation reaction is the Merox process. In the Merox process, the sour hydrocarbon stream is contacted with sodium hydroxide in the presence of a chelate catalyst of an iron-group metal. The mercaptans are converted into disulfides which concentrate in the hydrocarbon phase. The Merox process avoids the problem of adding undesirable metal compounds which remain in the hydrocarbon stream, but it still requires the undesirable phase separation.

4. Solvent Extraction

The second basic process desulfurizes sour hydrocarbons by extracting the mercaptans, or their derivatives, from the hydrocarbons with a suitable solvent which is immiscible with the hydrocarbons. The first widely-used solvent was sodium hydroxide. Later, it was found that the addition of a solutizing agent such as naphthenic acid, potassium isobutyrate, or cresol, would improve the efficiency of the extraction. A further refinement of the sodium hydroxide solvent extraction process is the Unisol process, also called the sodium alcoholate process. In this process, an alcohol, preferably methanol, is added to the sodium hydroxide. The sodium alcoholate which is formed then reacts with the mercaptans to form derivatives which concentrate in the sodium hydroxide phase. All of the solvent extraction processes suffer from the disadvantage of requiring a phase separation.

5. Adsorption

The third basic process desulfurizes sour hydrocarbons by contact with a suitable high surface area adsorbent. Before 1945, bauxite and Fuller's earth were commonly used. Subsequent disclosures have taught the use of refractory oxides such as silica and alumina. More recently the use of certain molecular seives has been disclosed.

For example, Brooke, U.S. Pat. No. 3,051,646, teaches that sulfur compounds can be removed from a hydrocarbon stream by contact with a suitable molecular sieve at a temperature of 70° to 200° F. and at a pressure of 0 to 600 psig. These contacting conditions are employed since adsorption is favored by low temperatures and high pressures. Suitable molecular sieve adsorbents are crystalline aluminoslicates having an average pore diameter of at least 8 angstroms. Examples of such sieves include chabazite, phacolite, gmelinite, harmotome, and the like, or modifications thereof produced by base exchange. The operating examples in Brooke use the Linde Molecular Sieve 13-X as the adsorbent. Brooke further teaches that the molecular sieve adsorbents can be regenerated by heating, by purging with an inert gas, or by purging with hydrogen.

Innes, U.S. Pat. No. 4,098,684, also teaches the use of certain molecular sieves to selectively adsorb sulfur compounds from a hydrocarbon stream. Innes, at column 4, also teaches that low temperatures are preferred for adsorption, saying "The choice of optimum temperature to employ depends on an economic balance between the savings in zeolitic molecular sieve material by virtue of higher adsorption capabilities at lower temperatures and the cost of heat exchangers to obtain the lower temperature." The reason heat exchangers are necessary to obtain lower temperatures is because the sulfur treatment step is generally performed as the hydrocarbon fractions some off the crude still, and such fractions as gasoline and jet fuel come off at temperatures of about 200° to 650° F.

Innes teaches that suitable molecular sieve adsorbents are crystalline aluminosilicates in which the negative electro-valence of the structure is balanced by the inclusion within the crystal of cations, for example, alkali metal and alkaline earth metal ions such as sodium, potassium, calcium, and magnesium ions. The operating examples in Innes use the Line Molecular Sieve 13-X, the Davison Grade 516-4A Molecular Sieve, and the Davison Grade 522-5A Molecular Sieve. Innes further teaches that the molecular sieve adsorbents can be regenerated by purging with a non-adsorbable purge gas such as natural gas, methane, hydrogen, nitrogen, or carbon monoxide.

6. Metal Catalysis

A fourth basic process for treating sulfur-containing hydrocarbon streams is to sweeten and/or desulfurize by contact with catalytic metals associated with porous supports. Ferrara, U.S. Pat. No. 3,378,484, teaches sweetening by contact with particulate ion exchange materials having metal ions at their functional sites. This process converts mercaptans into both metal mercaptides, which remain part of the ion exchange material, and into disulfides.

Ferrara teaches that the preferred particulate ion exchange materials are the amorphous synthetic zeolites and the macroporous sulfonic acid resins. The metal is one found in Groups I-B, II-B, IV, V, VI, and VIII of the Periodic Table. The preferred metal ions include cupric, mercuric, silver, lead, cobaltic, ferric, platinum, and palladium. The contacting occurs at a temperature of 50° to 300° F., preferably at 100° to 250° F., and most preferably at 100° to 150° F.

Ondrey, U.S. Pat. No. 3,783,125, teaches a similar process in which a hydrocarbon stream containing mercaptans is contacted with a heavy metal exchanged aluminosilicate zeolite containing copper, chromium, tin, or mixtures thereof. The only teaching of temperature and pressure for the contacting is that the operating examples were performed at 170° to 180° F. and at 50 psig.

Eng, Canadian Pat. No. 913,005, teaches a desulfurization process in which a sulfur-containing, hydrocarbon stream is vaporized and then contacted with a catalyst consisting of: (1) an oxide or sulfide of a Group VI-B metal and (2) an oxide of iron, cobalt, or nickel, both on a porous support. The preferred catalyst is CoO and $MoO_3$ an $Al_2O_3$. Eng teaches that this process converts mercaptans into olefins and hydrogen sulfide.

In their article entitled "Catalytic Desulfurization of Condensed Thiophenes" in the April, 1977 issue of the *Journal of Heterocyclic Chemistry,* Klemm and Karchesy disclose a desulfurization process in which certain sulfur compounds are converted into hydrogen sulfide and a host of hydrocarbons. In this process, which was performed on a bench-scale, 1 gram of a condensed thiophene was dissolved in 150 milliliters of methanol and then contacted with a conventional hydrodesulfurization catalyst (sulfided CoO-$MoO_3$ on $Al_2O_3$) at 450° F. and atmospheric pressure.

7. Hydrodesulfurization

The fifth basic process desulfurizes hydrocarbons by contact with hydrogen gas in the presence of a special catalyst to form hydrogen sulfide. The catalyst is generally an oxide or sulfide of cobalt, molybdenum, tungsten, or nickel supported on alumina. Hydrodesulfurization is carried out at extreme conditions. The preferred temperature is from about 600° to 800° F. and the preferred pressure is from about 200 to 1500 psig. The process also consumes a large quantity of hydrogen gas. For example, the removal of 1.0 weight percent sulfur as hydrogen sulfide requires about 75 cubic feet of hydrogen per barrel of feed.

The hydrodesulfurization process has been widely used in oil refineries since about 1955. The wise use of this process is predicated on the availability of hydrogen gas at the refinery. In the past, the off-gas from the reformers has provided an adequate amount of hydrogen. Recently, however, the move has been toward the processing of crude petroleums containing much higher levels of sulfur. The higher levels of sulfur require larger amounts of hydrogen. Furthermore, synthetic crudes are being considered which would raise hydrogen consumption per barrel of oil by an order of magnitude. Thus, the readily available sources of hydrogen gas in an oil refinery will no longer be adequate for hydrodesulfurization.

SUMMARY OF THE INVENTION

The general object of this invention is to provide an improved process for sweetening and desulfurizing sulfur-containing hydrocarbon streams boiling at a temperature less than about 650° F. The more specific objects are to provide a process which:

(1) does not require the addition of metal reactants which inevitably appear in the treated hydrocarbon stream;

(2) does not require a phase separation of the hydrocarbons from an immiscible solvent;

(3) can be performed on the hydrocarbon fraction at the temperature and pressure at which it comes off the crude still;

(4) does not require the presence of a catalyst containing a Group VI or Group VIII metal;

(5) does not require the addition of hydrogen gas.

We have discovered that these objects can be obtained by contacting the sulfur-containing hydrocarbon stream boiling at a temperature less than about 650° F. with an oxidic catalyst at a temperature of about 300° to 650° F. and at a pressure of about 1 to 5 atmospheres. The oxidic catalyst comprises a molecular sieve selected from the group consisting of hydrogen-form molecular sieves and rare-earth-form molecular sieves. Under these conditions, the mercaptans present in the stream are catalytically converted into other compounds. The molecular sieves in the hydrogen-form or the rare-earth-form possess a catalytic activity which is critical to this process. Other types of molecular sieves, for example, those containing alkali metal or alkaline earth cations, are not suitable since they do not possess the necessary catalytic activity.

We have also discovered that the addition of about 0.01 to 1.0 weight percent of methanol to the hydrocarbon stream before the contacting with the oxidic catalyst improves the sweetening and desulfurizing.

DETAILED DESCRIPTION OF THE INVENTION

1. Reactions

This invention is a process for sweetening and desulfurizing sulfur-containing hydrocarbon streams boiling at a temperature less than about 650° F. The process comprises contacting the hydrocarbon stream with an oxidic catalyst at a temperature of about 300° to 650° F. and at a pressure of about 1 to 5 atmospheres. The oxidic catalyst comprises a molecular sieve selected from the group consisting of hydrogen-form molecular sieves and rare-earth-form molecular sieves. The sweetening and desulfurizing are improved if about 0.01 to 1.0 weight percent of methanol is added to the hydrocarbon stream before the contact with the oxidic catalyst.

While the Applicants do not want to be bound by theory, it is believed that the presence of the oxidic catalyst under these conditions catalyzes the reaction of mercaptans with hydrogen-donor molecules inherent in the hydrocarbon stream. For example, tetralin is a strong hydrogen-donor which is known to be present in the jet fuel fraction. Accordingly, the following desulfurization reaction is believed to occur at temperatures of about 300° to 650° F. and at pressures of about 1 to 5 atmospheres:

$$2\,RSH + C_{10}H_{12} \longrightarrow C_{10}H_8 + 2\,RH + 2\,H_2S$$

a mercaptan; tetralin; naphthalene; a hydrocarbon; hydrogen sulfide

The Applicants also believe that at least some adsorption onto the oxidic catalyst is occurring despite the unfavorably high temperatures and unfavorably low pressures.

When methanol is added, the Applicants believe that reaction with inherent hydrogen-donors and adsorption continue to occur. In addition, methanol is believed to react with the mercaptans via one or more of the following reactions:

$$RSH + CH_3OH \longrightarrow R{-}S{-}CH_3 + H_2O$$

a mercaptan; methanol; a methyl sulfide; water $$RSH + CH_3OH \longrightarrow RH + CH_2O + H_2S$$

a mercaptan; methanol; a hydrocarbon; formaldehyde; hydrogen sulfide $$RSH + CH_3OH \longrightarrow R{-}O{-}CH_3 + H_2S$$

a mercaptan; methanol; a methyl ether; hydrogen sulfide

2. Hydrocarbons

Sulfur-containing hydrocarbon streams which boil at less than about 650° F. are amenable to treatment by the process of this invention. Suitable streams include virgin distillates, which boil in the range of 350° to 650° F.; virgin naphthas, which boil in the range of 80° to 350° F.; butanes and butenes, which boil in the range of 10° to 40° F.; and the lighter gases, which boil at less than 10° F. Hydrocarbon streams which boil at temperatures greater than about 650° F., such as gas oil and residual oil, have excessive amounts of heavy, highly condensed aromatics which tend to deposit on the oxidic catalyst and quickly poison its activity.

The preferred hydrocarbon feedstocks are the virgin naphtha and virgin distillate fractions. These two fractions are preferred because they are removed from the crude still at elevated temperatures and can be quickly heated to the contacting temperature of 300° to 650° F. The more preferred feedstocks are virgin distillates such as jet fuel, kerosene, diesel fuel, or furnace oil since they boil in the range of 300° to 650° F. and can be contacted with the oxidic catalyst without the need of adding any further heat. The most preferred feedstock is jet fuel.

3. Amount of Methanol

The addition of methanol to the hydrocarbon stream before the contacting with the oxidic catalyst improves the sweetening and desulfurizing. The methanol is generally added in an amount of about 0.01 to 1.0 weight percent of the hydrocarbon stream. Amounts greater than about 1.0 weight percent are generally not used because of cost, limited solubility of the methanol in the feedstock, and because it is undesirable to have unreacted methanol in the hydrocarbon products. It is preferred to add the methanol in an amount of about 0.1 to 0.6 weight percent. The weight percentages are intended to represent average values since it is recognized that the methanol can be added continuously or intermittently.

4. Temperature

The contacting of the sulfur-containing hydrocarbon stream with the oxidic catalyst occurs at a temperature of about 300° to 650° F. To minimize mercaptan sulfur and total sulfur in the product, the higher temperatures within this range are preferred since the sweetening and desulfurizing reactions occur more quickly at higher temperatures. Temperatures above about 650° F. are not suitable because the rate of thermal coking significantly increases which, in turn, increases the rate of catalyst deactivation. Catalyst deactivation is explained below. For ease of operation, the contacting is preferably done at the temperature at which the hydrocarbon stream is removed from the crude still.

5. Pressure

The contacting of the sulfur-containing hydrocarbon stream with the oxidic catalyst occurs at a pressure of about 1 to 5 atmospheres. Pressure is thought to have a relatively small effect on the sweetening and desulfurizing. For ease of operation, the contacting is preferably done at the pressure at which the hydrocarbon stream is withdrawn from the crude still, which is generally atmospheric.

6. Space Velocity

The liquid hourly space velocity of the contacting is chosen to achieve the desired level of sweetening and desulfurizing in the product. The space velocity is generally in the range of about 1 to 10. The preferred space velocities are in the range of about 3 to 6.

7. Oxidic Catalyst

Suitable oxidic catalysts comprise a molecular sieve selected from the group consisting of hydrogen-form molecular sieves and rare-earth-form molecular sieves.

The molecular sieves suitable for the process of this invention have uniform pore structures of exceedingly small size, the cross-section diameter of the pores being in the range of about 5 to 20 angstroms, and often being in the range of about 6 to 12 angstroms. Suitable molecular sieves include crystalline borosilicates and crystalline aluminosilicates. A suitable crystalline borosilicate, AMS-1B, is described in U.S. Pat. No. 4,269,813. Suitable crystalline aluminosilicates include both naturally occurring and synthetic materials such as faujasite, chabazite, mordenite, Zeolite X (described in U.S. Pat. No. 2,882,244), Zeolite Y (described in U.S. Pat. No. 3,130,007), Zeolite ZSM-5 (described in U.S. Pat. No. 3,702,886), and the ultra-stable large-pore zeolites (described in U.S. Pat. Nos. 3,293,192 and 3,449,070).

The above mentioned molecular sieves generally occur naturally or are prepared in the sodium form in which sodium cations are interspersed in the crystalline structure of the sieve. The sodium cations balance the negative charges resulting from the substitution of the trivalent boron or aluminum atoms for the tetravalent silicon atom in the oxygen-cornered tetrahedral structure. The amount of sodium cations originally in the sieve is thus a function of the ratio of boron and/or aluminum atoms to silicon atoms and can range from about 2.0 to 15.0 weight percent. The sodium form molecular sieves possess minimal catalytic activity and are used primarily as adsorbents or water softeners.

To impart catalytic activity to the sodium form molecular sieves, it is necessary to exchange the sodium cations for hydrogen ions or rare earth metal ions. Catalytic activity increases as the percentage of sodium cations exchanged out increases. Generally, about 25.0 to 95.0 percent of the sodium ions are exchanged out in the ion exchange treatment. Molecular sieves treated in this manner are in the hydrogen or rare earth form and are suitable for use in the process of this invention.

In addition to comprising a molecular sieve component, suitable oxidic catalysts can also comprise a porous refractory matrix material. Suitable matrix materials can be either synthetic or naturally occurring and include alumina, silica, magnesia, boria, bauxite, titania, and natural and treated clays. Mixtures of two or more of these materials are also suitable. The preferred matrix materials are alumina and silica, and mixtures thereof. The most preferred matrix material for sweetening is alumina.

The molecular sieve can comprise a major or a minor amount of the oxidic catalyst, but generally comprises a minor amount. For most effective sweetening, it is preferred that the molecular sieve be present in an amount of about 2 to 20 weight percent and a porous refractory matrix be present in an amount of about 98 to 80 weight percent.

8. Catalyst Regeneration

When the oxidic catalyst is contacted with a sulfur-containing hydrocarbon feedstock over an extended period of time, carbonaceous deposits build up on the surface of the catalyst. These deposits are similar to the coke which is formed during the fluidized catalytic cracking of gas oils. The rate of build up on the oxidic catalyst is a function of the type of hydrocarbon stream being treated, the heavier streams such as heavy virgin distillates cause faster build ups than the lighter streams such as light virgin naphthas. Since these deposits deactivate the catalyst, replacement or regeneration of the catalyst becomes necessary.

Purging with an inert gas such as nitrogen or steam is ineffective to regenerate the activity of the oxidic catalyst. Accordingly, regeneration by combustion with oxygen is the preferred method. The techniques suitable for regenerating catalyst in fluidized catalytic cracking units are suitable for use in this process. These techniques comprise contacting the coked catalyst with an oxygen-containg gas such as air at a temperature of about 1000° to 1500° F. for a period of time sufficient to burn off essentially all of the coke.

9. Preferred Embodiment

The process of this invention is especially useful because it sweetens and desulfurizes sulfur-containing hydrocarbon streams such as jet fuel as they are drawn off the crude still without the need of changing either the temperature or pressure of the stream. A preferred embodiment of this process is to first charge a sulfur-containing crude petroleum to a distillation column operated at atmospheric pressure. The jet fuel stream boiling in the range from about 350° to 550° F. is drawn off the distillation column and about 0.01 to 1.0 weight percent of methanol is then added to the stream.

The jet fuel-methanol stream is then immediately sent to one of two reactor vessels arranged in parallel and filled with a fixed bed of oxidic catalyst. The contacting thus occurs at substantially the same temperature and pressure at which the jet fuel was withdrawn from the distillation column. The oxidic catalyst comprises a minor portion of a molecular sieve component selected from the group consisting of hydrogen-form molecular sieves and rare-earth-form molecular sieves. The contacting occurs at a liquid hourly space velocity such that the product jet fuel contains a mercaptan sulfur level less than about 30 parts per million.

When the oxidic catalyst becomes deactivated by the build up of coke, the jet fuel-methanol stream is redirected to the other reactor vessel. The catalyst in the first reactor is then regenerated by passing air through the fixed bed. When the catalyst in the second reactor becomes deactivated, the jet fuel-methanol stream is directed back to the first reactor.

10. Examples

The examples are illustrative only. The sweetening and desulfurizing of sulfur-containing hydrocarbon streams was studied using an apparatus which comprised a feed tank, a pump, a furnace, a vertical glass trickle bed reactor, a condenser, and a sample receiver.

The pump was an FMI model number R-431. The furnace was a Lindberg split-tube model controlled by a Eurotherm controller. The glass reactor was a 24-inch-long, 18-millimeter-outside-diameter tube with ball joints on each end. The reactor contained a perforated glass plate positioned about 8 inches from the bottom to support the catalyst bed. The reactor also contained an axial thermowell which extended through the bottom of the reactor to a point about 5 inches above the glass plate. A thermocouple was positioned about one-fourth inch below the top of the thermowell and was connected to a Doric digital indicator. The condenser was a 6-inch glass unit. The sample receiver was a 500 milliliter flask fitted with a fritted glass sparger.

The sulfur-containing hydrocarbon stream used in the experiments was a jet fuel base from the Number 12 crude still at the Amoco Oil Company's Whiting, Ind., oil refinery. The properties of the jet fuel base are given in Table I.

TABLE I

Properties of the Jet Fuel Base

| Property | Value |
|---|---|
| Distillation, ASTM | |
| °F. at 5 vol. % overhead | 368 |
| °F. at 50 vol. % overhead | 420 |
| °F. at 95 vol. % overhead | 498 |
| Gravity, °API | 41.5 |
| Specific Gravity | 0.8179 |
| Total sulfur, ppm | 1000 |
| Mercaptan sulfur, ppm | 188 |
| Mercaptan number | 15.4 |
| Refractive index | 1.4532 |
| Nitrogen, ppm | 5 |
| Bromine number | 0.6 |
| FIA, vol. % | |
| PN | 83.0 |
| O | 0.5 |
| A | 16.5 |

The procedure which was used in the experiments was as follows. Catalyst in the form of 12 to 20 mesh particles was dried for one-half hour on an Ohaus moisture determination balance. After drying, 16 cubic centimeters of catalyst were measured into a graduated cylinder. The cylinder was then stoppered until the catalyst was charged to the reactor.

Several 3 millimeter Pyrex glass beads were placed in the reactor above the glass bed plate to support the catalyst. The catalyst was then charged to the reactor. A glass wool plug was put on top of the catalyst and the rest of the reactor was filled with glass beads interspersed with small glass wool plugs.

The reactor was then placed in the split-tube furnace and heated to 500° F., unless otherwise noted. Nitrogen was passed through the reactor during heating as a purge. Upon reaching the reaction temperature, the nitrogen flow was stopped and the flow of the jet fuel was begun. The jet fuel was part liquid and part vapor as it exited the reactor at atmospheric pressure. The fuel was completely condensed in the condenser and sent to the sample receiver. Nitrogen gas was bubbled through the liquid in the receiver to strip any dissolved gases, particularly hydrogen sulfide, from the sample.

The jet fuel flow rate was 80 cubic centimeters per hour, thus giving a liquid hourly space velocity (LHSV) of 5. Since there was an exotherm of 50° to 70° F. as the jet fuel wetted the catalyst, sampling was delayed until the temperature stabilized. The sample period typically lasted 60 to 75 minutes.

After the sample period was completed, the jet fuel flow was ended and a nitrogen purge begun. The furnace was left on and nitrogen flowed through the reactor for at least 15 minutes. The furnace was then turned off and the reactor was cooled under nitrogen.

The total sulfur content of the product was determined by X-ray fluorescence. The mercaptan sulfur content of the product was determined by potentiometric titration, ASTM test D-1323. This test gives mercaptan sulfur content as a mercaptan number. The mercaptan number is converted into parts per million (ppm) units with the following equation:

$$\text{Mercaptan Sulfur (ppm)} = \frac{10 \times \text{Mercaptan Number}}{\text{Sample Specific Gravity}}$$

The various catalysts which were used in the experiments are described below. All the catalysts were calcined at 1000° F. for 3 hours before use.

Catalyst A was a gamma-alumina type. It was sold under the trade name Aero-100A by the American Cyanamid Company.

Catalyst B was a silica type. It was sold by the Davison Chemical Division of W. R. Grace & Company.

Catalyst C was a magnesia type. It was sold by the Harshaw Chemical Company, a subsidiary of the Kewanee Oil Company.

Catalyst D was a silica-alumina type. It was prepared from a silica-alumina sol and contained 79.3 weight percent silica and 20.7 weight percent alumina.

Catalyst E was a Y-type-sieve-in-silica-alumina type. The catalyst was supplied by the Davison Chemical Division of W. R. Grace & Company. It contained 42 weight percent of the hydrogen-form of the Y-type molecular sieve in a silica-alumina matrix.

Catalyst F was a Y-type-sieve-in-alumina type. The catalyst was prepared by mixing the hydrogen-form of SK-40, a Y-type molecular sieve sold by the Union Carbide Corporation, with Aero-100A, a gamma alumina sold by the American Cyanamid Company. The catalyst contained 77 weight percent Y-type molecular sieve and 23 weight percent alumina.

Catalyst G was a ZSM-5-type-sieve-in-silica-alumina type. The catalyst was prepared by mixing the ZSM-5-type sieve, a hydrogen-form sieve prepared according to U.S. Pat. No. 3,702,886, with a silica-alumina sol. The catalyst contained 50 weight percent ZSM-5-type molecular sieve, 40 weight percent silica, and 10 weight percent alumina.

Catalyst H was a ZSM-5-type-sieve-in-alumina type. The catalyst was prepared by mixing a ZSM-5-type sieve, a hydrogen-form sieve prepared according to U.S. Pat. No. 3,702,886, with an alumina sol. The catalyst contained 50 weight percent ZSM-5-type molecular sieve and 50 weight percent alumina.

Catalyst I was an AMS-1B-type-sieve-in-alumina type. The catalyst was prepared by mixing AMS-1B, a hydrogen-form borosilicate-type sieve prepared according to U.S. Pat. No. 4,269,813, with an alumina sol. The catalyst contained 30 weight percent AMS-1B-type molecular sieve and 70 weight percent alumina.

Catalysts, J, K, L, and M were Y-type-sieve-in-alumina types. They were prepared by mixing a Y-type-hydrogen-form molecular sieve sold by the Davison Chemical Division of W. R. Grace & Company with alumina sol. The catalysts contained 40, 20, 10, and 5 weight percent molecular sieve, respectively.

EXAMPLES 1-3

These examples show that a sulfur-containing hydrocarbon stream is sweetened and desulfurized by contact with a variety of oxidic catalysts.

In each example, a jet fuel stream containing 1000 ppm total sulfur and 188 ppm mercaptan sulfur was contacted at a temperature of 500° F., atmospheric pressure, and an LHSV of 5. Table II shows the amounts of sulfur in the treated jet fuels.

TABLE II

Sweetening and Desulfurizing With No Feed Additive

| Example | Catalyst | Catalyst Type | S in Product (ppm) Mercaptan | Total |
|---|---|---|---|---|
| 1 | F | Y Sieve in Al | 39 | 590 |
| 2 | G | ZSM-5 Sieve in Si—Al | 35 | 560 |
| 3 | H | ZSM-5 Sieve in Al | 14 | 560 |

As can be seen in Table II, all the catalysts dramatically reduced the mercaptan level in the jet fuel. Even Catalyst F, the least effective of the three, reduced over 79 percent (188-39/188) of the mercaptan sulfur. Catalyst H, the ZSM-5-type-sieve-in-alumina type, reduced the mercaptan level below the 30 ppm specification for jet fuel.

EXAMPLES 4-12

These examples show that a sulfur-containing hydrocarbon stream is sweetened and desulfurized by adding 0.4 weight percent methanol to the stream and then contacting with a variety of oxidic catalysts.

These examples also show that: (1) the addition of methanol improves the sweetening and desulfurizing process; (2) the presence of a molecular sieve component in the oxidic catalyst is critical; and (3) an alumina matrix in the oxidic catalyst is preferred for sweetening.

In each example, a jet fuel stream containing 1000 ppm total sulfur and 188 ppm mercaptan sulfur was contacted at a temperature of 500° F., atmospheric pressure, and an LHSV of 5. Table III shows the amounts of sulfur in the treated jet fuels.

TABLE III

Sweetening and Desulfurizing With Methanol as a Feed Additive

| Example | Catalyst | Catalyst Type | S in Product (ppm) Mercaptan | Total |
|---|---|---|---|---|
| 4 | A | Alumina | 153 | 1000 |
| 5 | B | Silica | 184 | 1000 |
| 6 | C | Magnesia | 157 | 958 |
| 7 | D | Silica—alumina | 47 | 580 |
| 8 | E | Y Sieve in Si—Al | 27 | 353 |
| 9 | F | Y Sieve in Al | 2 | 560 |
| 10 | G | ZSM-5 Sieve in Si—Al | 23 | 380 |
| 11 | H | ZSM-5 Sieve in Al | 8 | 544 |
| 12 | I | AMS-1B Sieve in Al | 4 | 420 |

A comparison of Examples 1-3 with Examples 9-11 shows that sweetening and desulfurizing are improved by adding 0.4 weight percent methanol to the hydrocarbon stream before contact with the oxidic catalyst.

A comparison of Examples 4—7 with Examples 8-12 shows that the presence of a molecular sieve component in the oxidic catalyst is critical to this invention. Specifically, each catalyst with a sieve component reduced the mercaptan level below the 30 ppm specification, but none of the non-sieve catalysts did so.

A comparison of Example 8 with Example 9, and of Example 10 with Example 11, shows that an alumina matrix is preferred over a silica-alumina matrix for sweetening. These same examples show that the reverse holds true for desulfurizing.

EXAMPLES 13-17

These examples show that feed additives other than methanol hinder the sweetening and desulfurizing process.

In these examples, various feed additives were added to a jet fuel stream before contact with Catalyst H, the ZSM-5-type-sieve-in-alumina type. In each example, a jet fuel stream containing 1000 ppm total sulfur and 188 ppm mercaptan sulfur was contacted at a temperature of 500° F., atmospheric pressure, and an LHSV of 5. Table IV shows the amounts of sulfur in the treated jet fuels.

TABLE IV

Sweetening and Desulfurizing With Various Feed Additives

| Example | Feed Additive Type | (Wt. %) | S in Product (ppm) Mercaptan | Total |
|---|---|---|---|---|
| 13 | Tetrahydrofuran | 0.06 | 14 | 540 |
| 14 | Cyclohexanol | 1.13 | 16 | 646 |
| 15 | Isopropanol | 0.75 | 20 | 580 |
| 16 | Isobutanol | 0.93 | 39 | 640 |
| 17 | Tetralin | 0.26 | 55 | 690 |

A comparison of Examples 3, 11, and 13-17 shows that methanol was the only additive which improved the sweetening and desulfurizing. The addition of 0.06 weight percent tetrahydrofuran had virtually no effect and the addition of other feed additives actually hindered the sweetening and desulfurizing.

EXAMPLES 18-20

These examples show that the sweetening process improves at higher temperatures.

In these examples, a jet fuel stream was contacted with Catalyst M, a Y-type-sieve-in-alumina type containing 5 weight percent molecular sieve, at temperatures of 400°, 460°, and 500° F. No feed additive was used. The jet fuel stream contained 188 ppm mercaptan sulfur and the contacting occurred at atmospheric pressure and an LHSV of 5. Table V shows the amount of mercaptan sulfur in the treated jet fuels.

TABLE V

| Example | Effect of Temperature on Sweetening: Contacting Temperature (°F.) | Mercaptan Sulfur in Product (ppm) |
|---|---|---|
| 18 | 400 | 20 |
| 19 | 460 | 16 |
| 20 | 500 | 10 |

A comparison of Examples 18, 19, and 20 shows that sweetening improves with increasing temperature.

EXAMPLES 21-24

These examples show that the preferred oxidic catalyst contains less than about 20 weight percent molecular sieve.

In these examples, a jet fuel stream was contacted with various oxidic catalysts of the Y-type-sieve-in-alumina type. The catalysts differed only in their ratio of molecular sieve component to alumina component.

In each example, a jet fuel stream containing 1000 ppm total sulfur and 188 ppm mercaptan sulfur was contacted at a temperature of 400° F., atmospheric pressure, and an LHSV of 5. No feed additive was used. Table VI shows the amounts of sulfur in the treated jet fuels.

TABLE VI

| Example | Effect of Ratio of Molecular Sieve Component to Alumina Component: Catalyst | Amount of Sieve (Wt. %) | S in Product (ppm): Mercaptan | Total |
|---|---|---|---|---|
| 21 | J | 40 | 37 | 620 |
| 22 | K | 20 | 35 | 640 |
| 23 | L | 10 | 20 | 650 |
| 24 | M | 5 | 20 | 660 |

A comparison of Examples 21-24 shows that an oxidic catalyst containing less than about 20 weight percent molecular sieve is preferred for sweetening.

What is claimed is:

1. A process for simultaneously sweetening and desulfurizing without added hydrogen a sulfur-containing hydrocarbon stream containing hydrogen donor compounds and boiling at a temperature less than about 650° F., the process comprising contacting the hydrocarbon stream with an oxidic catalyst, said catalyst and said stream being at a temperature of about 300° to 650° F. and at a pressure of about 1 to 5 atmospheres, the oxidic catalyst comprising a molecular sieve selected from the group consisting of hydrogen-form molecular sieves and rare-earth-form molecular sieves, whereby sulfur compounds and hydrogen from said hydrogen donor compounds in said stream are converted to hydrogen sulfide, and mercaptans present in said stream not converted to hydrogen sulfide are converted to other sulfur compounds.

2. The process of claim 1 wherein about 0.01 to 1.0 weight percent of methanol is added to the hydrocarbon stream before the contacting with the oxidic catalyst.

3. The process of claim 1 wherein the hydrocarbon stream comprises a fraction selected from the group consisting of virgin naphtha and virgin distillate.

4. The process of claim 3 wherein about 0.01 to 1.0 weight percent of methanol is added to the hydrocarbon stream before the contacting with the oxidic catalyst.

5. The process of claim 3 wherein the oxidic catalyst comprises a minor amount of the molecular sieve and a major amount of a porous refractory oxide.

6. The process of claim 5 wherein about 0.01 to 1.0 weight percent of methanol is added to the hydrocarbon stream before the contacting with the oxidic catalyst.

7. The process of claim 5 wherein the oxidic catalyst consists essentially of the molecular sieve in an alumina matrix.

8. The process of claim 7 wherein about 0.1 to 0.6 weight percent of methanol is added to the hydrocarbon stream before the contacting with the oxidic catalyst.

9. The process of claim 7 wherein the hydrocarbon stream comprises jet fuel.

10. The process of claim 9 wherein about 0.1 to 0.6 weight percent of methanol is added to the hydrocarbon stream before the contacting with the oxidic catalyst.

11. The process of claim 9 wherein the molecular sieve in the oxidic catalyst is present in an amount of about 2 to 20 weight percent and the alumina matrix is present in an amount of about 98 to 80 weight percent.

12. The process of claim 11 wherein about 0.1 to 0.6 weight percent of methanol is added to the hydrocarbon stream before the contacting with the oxidic catalyst.

13. A process for producing jet fuel having less than 30 parts per million by weight mercaptan sulfur, the process comprising:

(a) charging a crude petroleum to a distillation column operated at about atmospheric pressure;

(b) drawing off the jet fuel stream containing both mercaptans and other sulfur compounds and boiling in the range from about 350° to 550° F.;

(c) adding about 0.01 to 1.0 weight percent of methanol to the jet fuel stream; and then (d) contacting the jet fuel-methanol stream with an oxidic catalyst at substantially the same temperature and pressure at which the jet fuel stream was withdrawn, the oxidic catalyst comprising a molecular sieve selected from the group consisting of hydrogen-form molecular sieves and rare-earth-form molecular sieves, whereby sulfur compounds in said jet fuel stream are converted to hydrogen sulfide and mercaptans present in said jet fuel stream not converted to hydrogen sulfide are converted to other sulfur compounds.

14. The process of claim 13 wherein the oxidic catalyst comprises a minor amount of the molecular sieve and a major amount of a porous refractory oxide.

15. The process of claim 14 wherein the oxidic catalyst consists essentially of the molecular sieve in an alumina matrix.

16. The process of claim 15 wherein the molecular sieve in the oxidic catalyst is present in an amount of about 2 to 20 weight percent and the alumina matrix is present in an amount of about 98 to 80 weight percent.

17. The process of claim 16 wherein the methanol is added in an amount of about 0.1 to 0.6 weight percent.

* * * * *